US011480907B2

(12) United States Patent
Nagato

(10) Patent No.: US 11,480,907 B2
(45) Date of Patent: Oct. 25, 2022

(54) SHEET CONVEYANCE METHOD, SHEET CONVEYANCE APPARATUS, AND IMAGE FORMING SYSTEM

(71) Applicant: Konica Minolta, Inc., Tokyo (JP)

(72) Inventor: Hiromu Nagato, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 463 days.

(21) Appl. No.: 16/658,746

(22) Filed: Oct. 21, 2019

(65) Prior Publication Data

US 2020/0125023 A1 Apr. 23, 2020

(30) Foreign Application Priority Data

Oct. 23, 2018 (JP) ..... JP2018-199174

(51) Int. Cl.
*B65H 9/10* (2006.01)
*G03G 15/00* (2006.01)

(52) U.S. Cl.
CPC ..... *G03G 15/6529* (2013.01); *B65H 9/101* (2013.01); *G03G 15/6582* (2013.01)

(58) Field of Classification Search
CPC .. B65H 9/101; B65H 7/10; B65H 2404/6111; B65H 2511/11
See application file for complete search history.

(56) References Cited

U.S. PATENT DOCUMENTS 6,361,042 B1 3/2002 Shimura et al.
7,281,710 B2 * 10/2007 Okazaki ..... B65H 29/30 271/193
7,500,668 B2 * 3/2009 DeJong ..... B65H 9/20 271/227
9,242,828 B2 * 1/2016 Mader ..... B65H 29/243
9,676,577 B2 * 6/2017 Schoenmakers ..... B65H 5/068
9,701,104 B2 * 7/2017 Nijkamp ..... B41F 21/00
10,582,075 B2 * 3/2020 Shiokawa ..... H04N 1/00824
10,589,946 B2 * 3/2020 Maehara ..... B65H 9/101
2015/0014916 A1 1/2015 Saito et al.
2016/0280488 A1 9/2016 Watanabe et al.
2021/0024309 A1 * 1/2021 Zhou ..... B65H 7/16

FOREIGN PATENT DOCUMENTS

JP H10-338410 A 12/1998
JP 2000-281244 A 10/2000
JP 3712101 B2 * 11/2005
JP 2015016980 A 1/2015

OTHER PUBLICATIONS

Extended European Search Report issued in corresponding European Patent Application No. 19204953.4, dated Mar. 25, 2020 (8 pages).
Office Action issued in counterpart Japanese Patent Application No. JP 2018-199174, dated Aug. 2, 2022, with translation (10 pages).

* cited by examiner

*Primary Examiner* — Howard J Sanders
(74) *Attorney, Agent, or Firm* — Osha Bergman Watanabe & Burton LLP

(57) ABSTRACT

A sheet conveyance method using a sheet conveyance apparatus that includes a conveyance path and a plurality of alignment members disposed along the conveyance path, the method includes: determining a set of alignment members to be operated based on a length of the paper sheet from among the plurality of alignment members; and aligning the paper sheet conveyed on the conveyance path using the determined set of alignment members.

10 Claims, 14 Drawing Sheets

FIG. 14A

| SHEET LENGTH [mm] | ALIGNMENT MEMBERS 150A-150C | | ALIGNMENT MEMBERS 150A-150D | | ALIGNMENT MEMBERS 150A-150E | |
|---|---|---|---|---|---|---|
| | COVER RATE [%] | MISALIGNMENT [mm] | COVER RATE [%] | MISALIGNMENT [mm] | COVER RATE [%] | MISALIGNMENT [mm] |
| 540 | 98 | 0.1 | | | | |
| 550 | 96 | 0.2 | | | | |
| 560 | 94 | 0.3 | | | | |
| 570 | 93 | 0.4 | | | | |
| 580 | 91 | 0.5 | | | | |
| 590 | 89 | 0.6 | | | | |
| 600 | 88 | 0.6 | | | | |
| 610 | 87 | 0.7 | | | | |
| 620 | 85 | 0.8 | | | | |
| 630 | 84 | 0.9 | | | | |
| 640 | 83 | 0.9 | | | | |
| 650 | 81 | 1.0 | | | | |
| 660 | 80 | 1.1 | | | | |
| 670 | 79 | 1.1 | | | | |
| 680 | 78 | 1.2 | | | | |
| 690 | 77 | 1.2 | | | | |
| 700 | 75 | 1.3 | | | | |
| 710 | 74 | 1.4 | | | | |
| 720 | 73 | 1.4 | 100 | 0.0 | | |
| 730 | 72 | 1.5 | 98 | 0.1 | | |
| 740 | 71 | 1.5 | 97 | 0.2 | | |
| 750 | 70 | 1.6 | 96 | 0.2 | | |
| 760 | 69 | 1.6 | 94 | 0.3 | | |
| 770 | 69 | 1.7 | 93 | 0.4 | | |
| 780 | 68 | 1.7 | 92 | 0.4 | | |
| 790 | 67 | 1.8 | 91 | 0.5 | | |

FIG. 14B

| SHEET LENGTH [mm] | ALIGNMENT MEMBERS 150A-150C | | ALIGNMENT MEMBERS 150A-150D | | ALIGNMENT MEMBERS 150A-150E | |
|---|---|---|---|---|---|---|
| | COVER RATE [%] | MISALIGNMENT [mm] | COVER RATE [%] | MISALIGNMENT [mm] | COVER RATE [%] | MISALIGNMENT [mm] |
| 800 | 66 | 1.8 | 90 | 0.5 | | |
| 810 | 65 | 1.8 | 89 | 0.6 | | |
| 820 | 64 | 1.9 | 88 | 0.7 | | |
| 830 | 64 | 1.9 | 87 | 0.7 | | |
| 840 | 63 | 2.0 | 85 | 0.8 | | |
| 850 | 62 | 2.0 | 84 | 0.8 | | |
| 860 | 61 | 2.0 | 83 | 0.9 | | |
| 870 | 61 | 2.1 | 83 | 0.9 | | |
| 880 | 60 | 2.1 | 82 | 1.0 | | |
| 890 | 59 | 2.2 | 81 | 1.0 | | |
| 900 | 59 | 2.2 | 80 | 1.1 | | |
| 910 | 58 | 2.2 | 79 | 1.1 | | |
| 920 | 57 | 2.3 | 78 | 1.2 | | |
| 930 | 57 | 2.3 | 77 | 1.2 | | |
| 940 | 56 | 2.3 | 76 | 1.3 | | |
| 950 | 56 | 2.4 | 76 | 1.3 | | |
| 960 | 55 | 2.4 | 75 | 1.3 | | |
| 970 | 54 | 2.4 | 74 | 1.4 | 100 | 0.0 |
| 980 | 54 | 2.4 | 73 | 1.4 | 99 | 0.0 |
| 990 | 53 | 2.5 | 73 | 1.5 | 98 | 0.1 |
| 1000 | 53 | 2.5 | 72 | 1.5 | 97 | 0.1 |
| 1010 | 52 | 2.5 | 71 | 1.5 | 96 | 0.2 |
| 1020 | 52 | 2.6 | 70 | 1.6 | 95 | 0.2 |
| 1030 | 51 | 2.6 | 70 | 1.6 | 95 | 0.3 |
| 1040 | 51 | 2.6 | 69 | 1.6 | 94 | 0.3 |
| 1050 | 50 | 2.6 | 68 | 1.7 | 93 | 0.4 |

FIG. 14C

| SHEET LENGTH [mm] | ALIGNMENT MEMBERS 150A-150C | | ALIGNMENT MEMBERS 150A-150D | | ALIGNMENT MEMBERS 150A-150E | |
|---|---|---|---|---|---|---|
| | COVER RATE [%] | MISALIGNMENT [mm] | COVER RATE [%] | MISALIGNMENT [mm] | COVER RATE [%] | MISALIGNMENT [mm] |
| 1060 | 50 | 2.7 | 68 | 1.7 | 92 | 0.4 |
| 1070 | 49 | 2.7 | 67 | 1.7 | 91 | 0.5 |
| 1080 | 49 | 2.7 | 66 | 1.8 | 90 | 0.5 |
| 1090 | 48 | 2.7 | 66 | 1.8 | 89 | 0.6 |
| 1100 | 48 | 2.8 | 65 | 1.8 | 89 | 0.6 |
| 1110 | 48 | 2.8 | 65 | 1.9 | 88 | 0.6 |
| 1120 | 47 | 2.8 | 64 | 1.9 | 87 | 0.7 |
| 1130 | 47 | 2.8 | 64 | 1.9 | 86 | 0.7 |
| 1140 | 46 | 2.8 | 63 | 2.0 | 85 | 0.8 |
| 1150 | 46 | 2.9 | 62 | 2.0 | 85 | 0.8 |
| 1160 | 46 | 2.9 | 62 | 2.0 | 84 | 0.9 |
| 1170 | 45 | 2.9 | 61 | 2.0 | 83 | 0.9 |
| 1180 | 45 | 2.9 | 61 | 2.1 | 83 | 0.9 |
| 1190 | 44 | 3.0 | 60 | 2.1 | 82 | 1.0 |
| 1200 | 44 | 3.0 | 60 | 2.1 | 81 | 1.0 |
| 1210 | 44 | 3.0 | 59 | 2.2 | 80 | 1.0 |
| 1220 | 43 | 3.0 | 59 | 2.2 | 80 | 1.1 |
| 1230 | 43 | 3.0 | 58 | 2.2 | 79 | 1.1 |
| 1240 | 43 | 3.0 | 58 | 2.2 | 79 | 1.1 |
| 1250 | 42 | 3.1 | 57 | 2.3 | 78 | 1.2 |
| 1260 | 42 | 3.1 | 57 | 2.3 | 77 | 1.2 |
| 1270 | 42 | 3.1 | 57 | 2.3 | 77 | 1.2 |
| 1280 | 41 | 3.1 | 56 | 2.3 | 76 | 1.3 |
| 1290 | 41 | 3.1 | 56 | 2.4 | 76 | 1.3 |
| 1300 | 41 | 3.1 | 55 | 2.4 | 75 | 1.3 |

SHEET CONVEYANCE METHOD, SHEET CONVEYANCE APPARATUS, AND IMAGE FORMING SYSTEM

CROSS-REFERENCE TO RELATED APPLICATION

The entire disclosure of Japanese Patent Application No. 2018-199174, filed on Oct. 23, 2018, is incorporated herein by reference.

BACKGROUND

Technical Field

The present invention relates to a sheet conveyance method, a sheet conveyance apparatus, and an image forming system.

Description of the Related Art

For example, even when a good image is formed on a paper sheet, in a case where misalignment (bend or inclination) occurs in the paper sheet before being subjected to post-processing such as cutting, a defective product (inclined or bent deliverable) is yielded as an output product subjected to the post-processing. Furthermore, jam may disadvantageously occur depending on a degree of misalignment of the paper sheet.

Accordingly, an alignment member for correcting misalignment of the paper sheet is provided in a sheet conveyance apparatus positioned between an image forming apparatus and a post-processing apparatus (e.g., see JP 2015-16980 A).

SUMMARY

However, the alignment member is disposed to align a leading edge and a trailing edge of the paper sheet. Accordingly, a center portion of the paper sheet may not follow alignment operation of the alignment member due to rigidity of the paper sheet, bend of a conveyance path, and the like, disadvantageously making correction of misalignment (bend or inclination) insufficient. Specifically, when the paper sheet is a long sheet in a conveyance direction, correction of misalignment becomes insufficient.

In contrast, when an alignment member is provided that deals with a whole length region of sheet, a size of the alignment member (alignment mechanism) increases, resulting in upsizing the sheet conveyance apparatus.

One or more embodiments of the present invention provide a sheet conveyance method, a sheet conveyance apparatus, and an image forming system capable of successfully correcting misalignment (bend or inclination) of paper sheets having various sizes while suppressing upsizing of the sheet conveyance apparatus.

A sheet conveyance method of one or more embodiments of the present invention comprises aligning a paper sheet conveyed on a conveyance path in a sheet conveyance apparatus having a plurality of alignment members disposed along the conveyance path for the paper sheet. In the aligning, two or more alignment members to be operated are determined from among the plurality of alignment members based on a sheet length of the paper sheet, and the paper sheet is aligned by the determined alignment members.

A sheet conveyance apparatus of one or more embodiments of the present invention includes: a conveyance path for a paper sheet; a plurality of alignment members disposed along the conveyance path; and a control unit that controls the plurality of the alignment members, wherein the control unit determines two or more of the alignment members to be operated depending on a sheet length of the paper sheet, and makes the determined alignment members align the paper sheet.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 14A is a table for illustrating a relation among sheet length, cover rate, and misalignment according to one or more embodiments;

FIG. 14B is a table subsequent to FIG. 14A;

FIG. 14C is a table subsequent to FIG. 14B;

DETAILED DESCRIPTION

Figure 1:
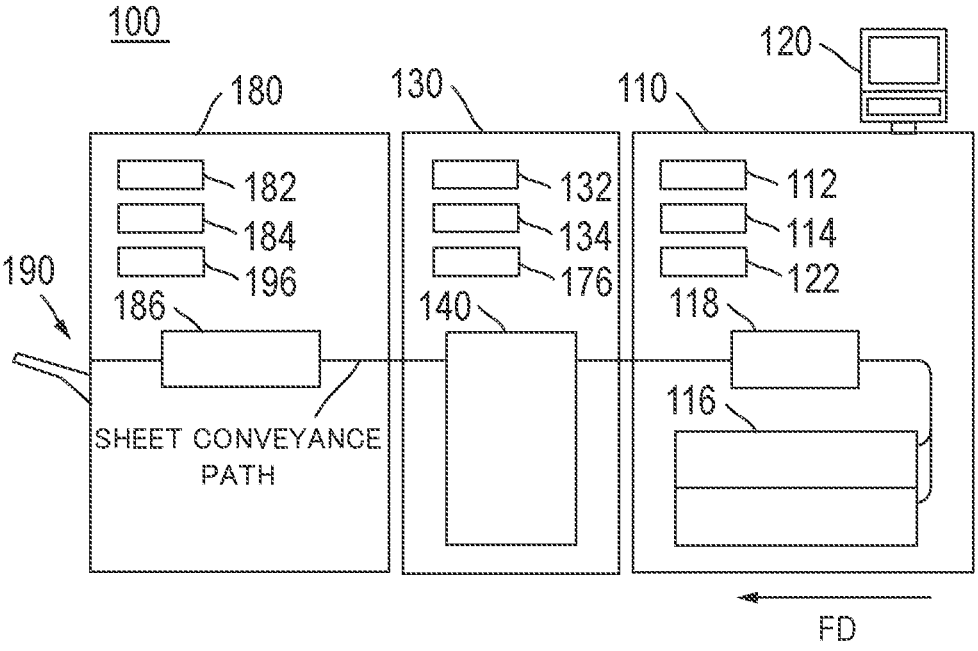
FIG. 1 is a schematic view for illustrating an image forming system according to one or more embodiments of the present invention.

Hereinafter, embodiments of the present invention will be described with reference to the drawings. However, the scope of the invention is not limited to the disclosed embodiments. In the description of the drawings, the same elements are denoted by the same reference numerals, and redundant description is omitted. In addition, in some cases, dimensional ratios in the drawings are exaggerated and different from actual ratios for convenience of the description.

Hereinafter, one or more embodiments of the present invention will be described with reference to the accompanying drawings. Note that, in some cases, dimensional ratios in the drawings are exaggerated and different from actual ratios for convenience of the description.

Figure 2:
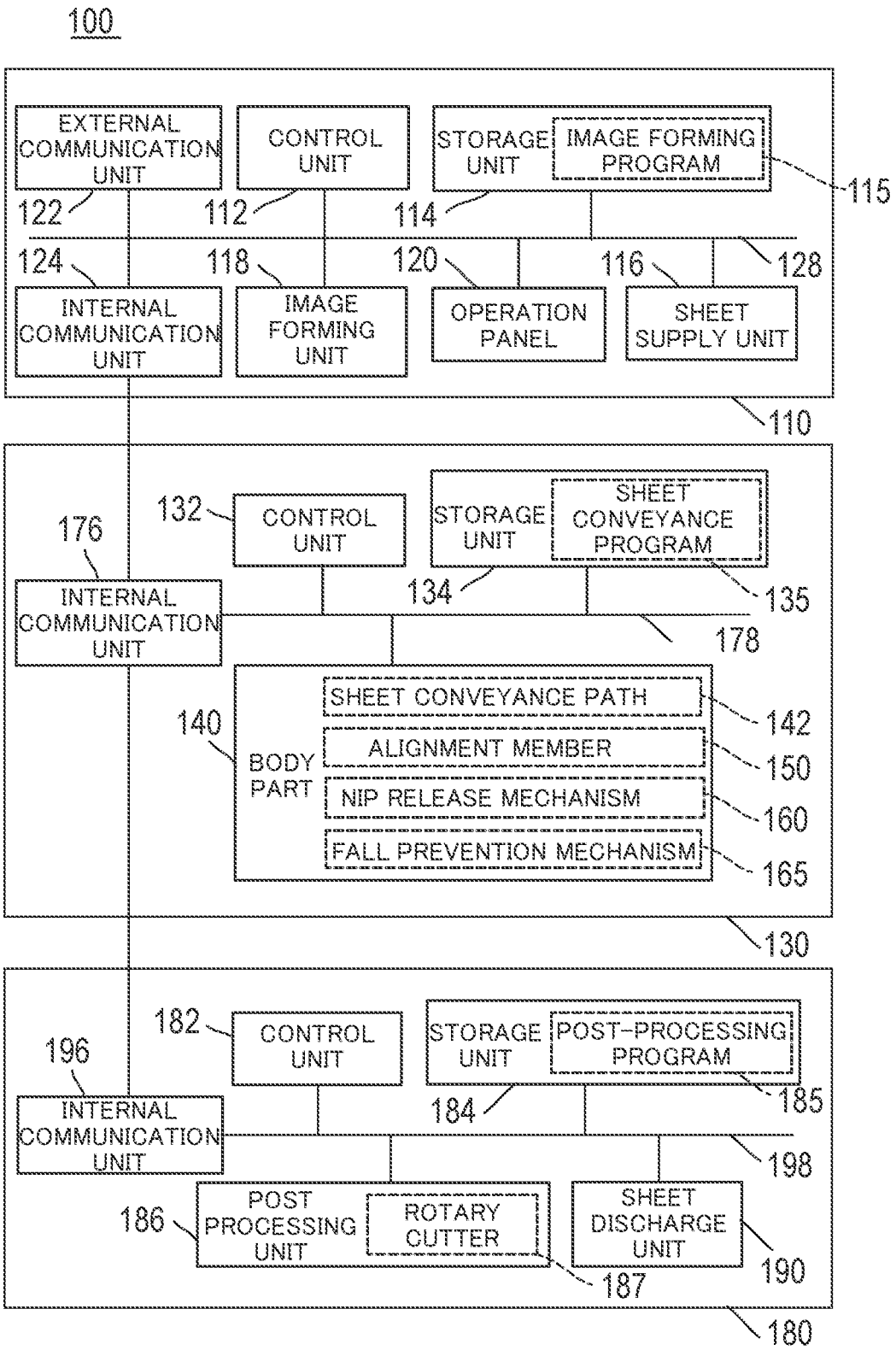
FIG. 2 is a block diagram for illustrating the image forming system according to one or more embodiments of the present invention.

FIG. 1 and FIG. 2 are respectively a schematic view and a block diagram for illustrating an image forming system according to one or more embodiments of the present invention.

The image forming system 100 according to one or more embodiments of the present invention includes an image forming apparatus 110, a sheet conveyance apparatus 130, and a post-processing apparatus 180 as illustrated in FIG. 1 and FIG. 2.

The image forming apparatus 110 forms a body part of the image forming system 100, is positioned on an upstream side of the sheet conveyance apparatus 130 in a sheet conveyance direction FD, and is used to generate image data from print data included in a print job and form (print) an image on a paper sheet to be supplied to the sheet conveyance apparatus 130. Note that the paper sheet is referred to by a sheet in the following as appropriate.

The print job is, for example, obtained from an external computer. The print data is data written by, for example, a language form of PDL (Page Description Language) such as PostScript or PCL (Printer Control Language), and includes print setting information and image information. The print setting information includes, for example, sheet size information such as sheet length, and post-processing setting data. The sheet includes a long sheet such as a poster, a band (wraparound band) of book. The poster is, for example, an art printed poster, an interior poster, or a strap advertisement (hanging poster, poster on window, door side poster). In one or more embodiments, the post-processing is top and bottom slit (top and bottom cutting) of sheet, and the post-processing setting data includes margin information (cutting position) of sheet, finished size (outline data), and the like.

The image forming apparatus 110 includes a control unit (controller) 112, a storage unit 114, a sheet supply unit 116, an image forming unit 118, an operation panel 120, an external communication unit 122, and an internal communication unit 124, which are communicatively connected with each other via a bus 128.

The control unit 112 is a control circuit formed of a CPU (Central Processing Unit), an ASIC (Application Specific Integrated Circuit), and the like that execute control of the above-mentioned each unit and various kinds of arithmetic processing in accordance with programs, and functions of the image forming apparatus 110 are exerted by executing the respective programs by the CPU (control unit 112).

The storage unit 114 may be formed of, for example, a combination of a ROM (Read Only Memory), a RAM (Random Access Memory), a non-volatile memory, an SSD (Solid State Drive), an HDD (Hard Disk Drive), and the like.

A program stored in the storage unit 114 is, for example, an image forming program 115. The image forming program 115 controls the image forming unit 118, and has a function of forming (printing) an image on a sheet and a function of transmitting control data to control the sheet conveyance apparatus 130 and the post-processing apparatus 180. Data stored in the storage unit 114 is print job information, bit map data converted by RIP (rasterize: Raster Image Processing), and the like.

The sheet supply unit 116 includes a plurality of sheet feed trays, and used to take out a sheet instructed from the control unit 112 from a corresponding one of the sheet feed trays to convey the sheet toward the image forming unit 118.

The image forming unit 118 is used to from a toner image on a sheet by using an electrophotographic process including charging, exposure, development, and transfer and fixing processes. An image forming method is not limited to an electrophotographic type, and an impact type, a thermal transfer type, an inject type, or the like may be also applicable.

The operation panel 120 includes an input unit and a display unit. The input unit includes, for example, a physical keyboard. The physical keyboard is used by the user to execute character input, various settings, various instructions (inputs) such as start instruction. The display unit is formed of, for example, an LCD (Liquid Crystal Display) and a touch panel, and used to notify the user of progress of print job, setting capable of being changed at the moment, warning for calling attention to the user, and the like.

The external communication unit 122 connects with an external computer via a network, and is used to execute transmission and reception of data such as print job. The network is formed of various networks such as a local area network (LAN), a wide area network (WAN) in which LANs are connected with each other by a dedicated line, the Internet, or a combination thereof. Standards of connecting between computers and network equipment include, for example, the Ethernet (registered trademark). A network protocol is, for example, TCP/IP (Transmission Control Protocol/Internet Protocol).

The internal communication unit 124 is used to execute transmission and reception of data between with the sheet conveyance apparatus 130, and transmission and reception of data between with the post-processing apparatus 180. The data transmitted and received between with the sheet conveyance apparatus 130 is, for example, sheet size information such as sheet length necessary to align sheet. The data transmitted and received between with the post-processing apparatus 180 is, for example, post-processing information including margin information (cutting position), finished size (outline data), and the like of sheet.

The sheet conveyance apparatus 130 is used to align a sheet on which an image is formed (printed) supplied from the image forming apparatus 110, correct misalignment (bend or inclination) of the sheet, and supply the sheet to the post-processing apparatus 180, and includes a control unit 132, a storage unit 134, a body part 140, and an internal communication unit 176, which are communicatively connected with each other via a bus 178.

The control unit 132 is a control circuit formed of a CPU, an ASIC, and the like that execute control of the above-mentioned each unit and various kinds of arithmetic processing in accordance with programs, and functions of the sheet conveyance apparatus 130 are exerted by the respective programs executed by the CPU (control unit 132).

The storage unit 134 may be formed of, for example, a combination of a ROM, a RAM, a non-volatile memory, an SSD, an HDD, and the like. A program stored in the storage unit 134 is, for example, a sheet conveyance program 135. The sheet conveyance program 135 is used to control the sheet conveyance apparatus 130 (body part 140) in cooperation with the image forming program 115 of the image forming apparatus 110. Data stored in the storage unit 134 is, for example, sheet size information.

The body part 140 includes a sheet conveyance path 142, an alignment member 150, a nip release mechanism 160, and a fall prevention mechanism 165, and used for alignment in a sheet width direction WD perpendicular to the sheet conveyance direction FD. Note that the sheet width direction WD corresponds to an alignment direction.

The internal communication unit 176 is used to execute transmission and reception of data between with the image forming apparatus 110, and transmission and reception of data between with the post-processing apparatus 180.

The post-processing apparatus 180 is positioned on a downstream side of the sheet conveyance apparatus 130 in the sheet conveyance direction, is used to subject the sheet aligned by the sheet conveyance apparatus 130 to post processing, and includes a control unit 182, a storage unit 184, a post-processing unit 186, a sheet discharge unit 190, and an internal communication unit 196, which are communicatively connected with each other via a bus 198.

The control unit 182 is a control circuit formed of a CPU, an ASIC, and the like that executes control of the above-mentioned each unit and various kinds of arithmetic processing in accordance with programs, and functions of the post-processing apparatus 180 are exerted by the respective programs executed by the CPU (control unit 182).

The storage unit 184 may be formed of, for example, a combination of a ROM, a RAM, a non-volatile memory, an SSD, an HDD, and the like. A program stored in the storage unit 184 is, for example, a post-processing program 185. The post-processing program 185 is used to control the post-processing apparatus 180 (the post-processing unit 186) in cooperation with the image forming program 115 of the image forming apparatus 110. Data stored in the storage unit 134 is, for example, post-processing setting information.

The post-processing unit 186 includes, for example, a rotary cutter 187. The rotary cutter 187 has a disc shape, and is configured such that top and bottom slit (top and bottom cutting) of sheet and the like are executable.

The sheet supplied to the post-processing unit 186 is aligned in the sheet width direction WD perpendicular to the sheet conveyance direction FD by the body part 140 of the sheet conveyance apparatus 130 to be corrected in its misalignment (bend or inclination). Accordingly, yielding a defective product (inclined or bent deliverable) is suppressed when the paper is cut by the rotary cutter 187.

The sheet discharge unit 190 has a discharge tray extended outside the device, and is used to discharge the sheet subjected to post-processing into a discharge tray.

The internal communication unit 196 is used to execute transmission and reception of data between with the image forming apparatus 110 and transmission and reception of data between with the sheet conveyance apparatus 130.

Note that the sheet conveyance apparatus 130 is not limited to be independently provided, and can be united with the image forming apparatus 110 or the post-processing apparatus 180.

A mechanism for cutting sheet is not limited to use the rotary cutter 187. Also, a portion of sheet to be cut is not limited to top and bottom, and for example, can be a side surface (small volume). The post-processing is not limited to the cut processing, and punching processing for punching an end of sheet for filing, side-stitching processing for fastening a portion about 5 mm from an end of a sheet stack with a staple needle as a binding margin, folding groove processing for forming a folding groove on sheet, Z-fold processing for bending sheet by two times to have a Z character shape when viewed from an extended line direction of creases, saddle stitching processing for folding a center to stitch a crease portion using a staple, and the like are applicable.

Next, the body part 140 of the sheet conveyance apparatus 130 will be described in detail.

Figure 3:
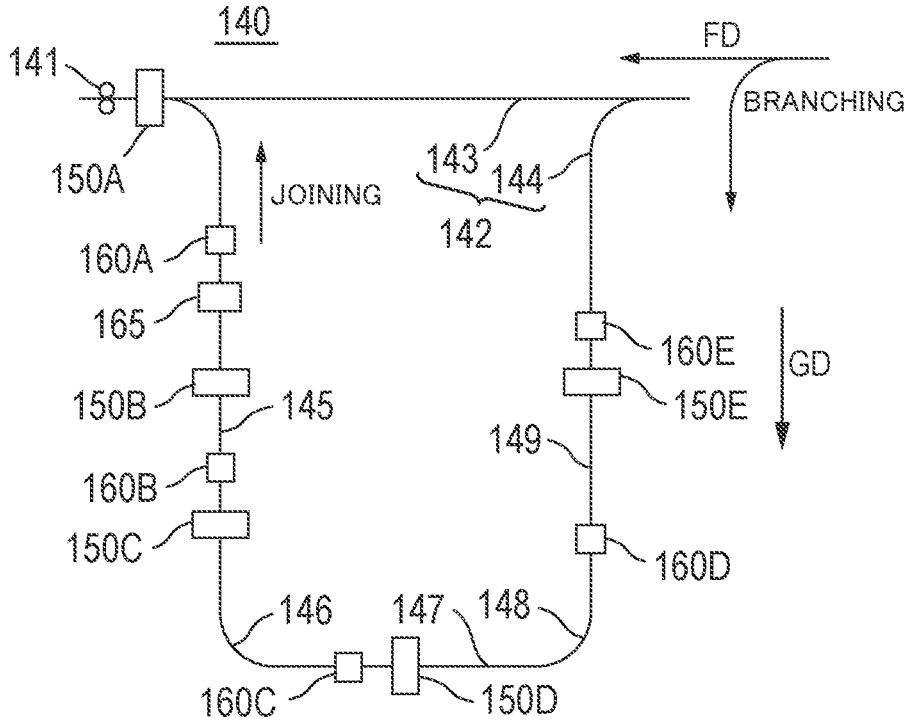
FIG. 3 is a schematic view for illustrating a body part of a sheet conveyance apparatus according to one or more embodiments of the present invention.
Figure 4:
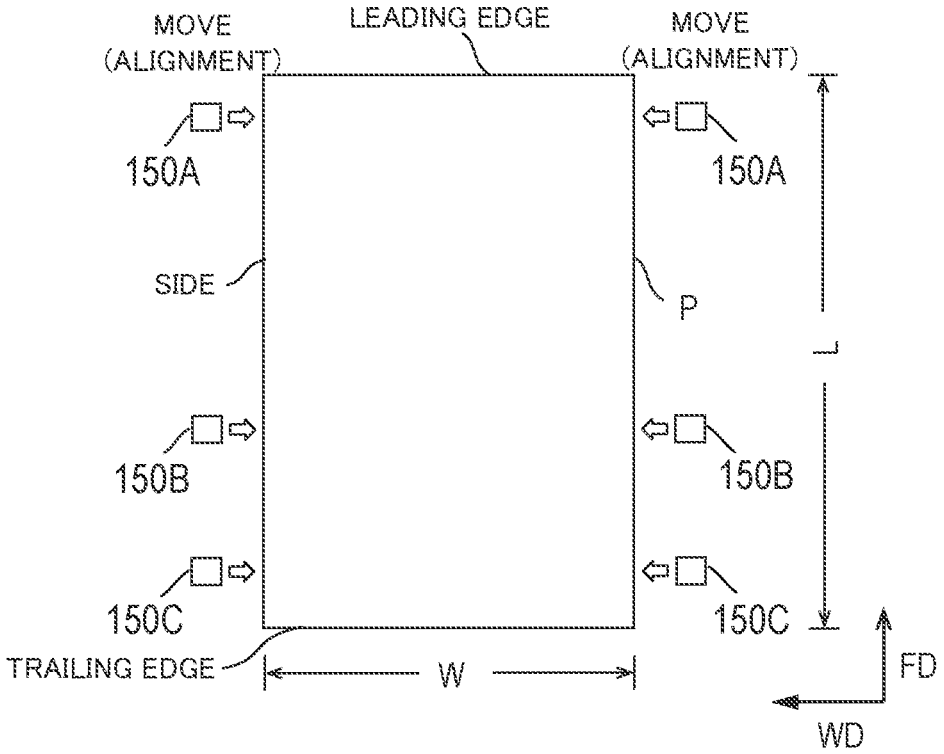
FIG. 4 is a schematic view for illustrating an alignment member illustrated in FIG. 3.
Figure 5:
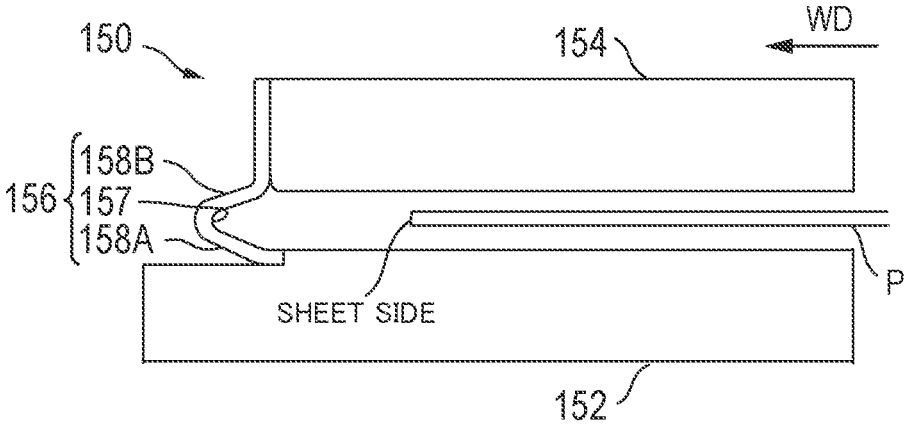
FIG. 5 is a side view for illustrating the alignment member illustrated in FIG. 3.
Figure 6:
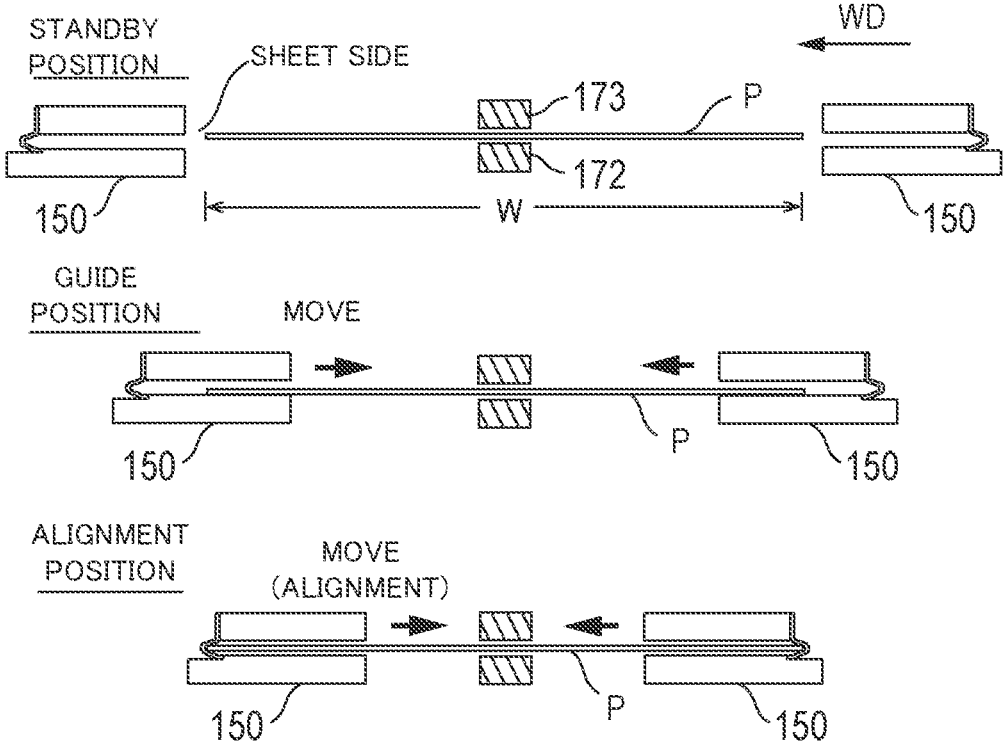
FIG. 6 is a schematic view for illustrating a standby position, a guide position, and an alignment position of the alignment member according to one or more embodiments.

FIG. 3 is a schematic view for illustrating the body part of the sheet conveyance apparatus according to one or more embodiments of the present invention, FIG. 4 and FIG. 5 are respectively a schematic view and a side view for illustrating the alignment member illustrated in FIG. 3, and FIG. 6 is a schematic view for illustrating a standby position, a guide position, and an alignment position of the alignment member.

The sheet conveyance path 142 provided in the body part 140 includes a short distance path 143 and a long distance path 144 as illustrated in FIG. 3. Note that, the reference numeral 141 denotes a roller configured to position a leading edge of the sheet P by being made contact with the leading edge of the sheet P.

The short distance path 143 is a path on which a sheet (non-long sheet) P scarcely needed to correct its misalignment (bend or inclination) due to short sheet length. That is, the short distance path 143 is a straight path through which the sheet P subjected to no alignment processing passes, and no alignment member 150 is disposed on the short distance path 143.

The long distance path 144 is a detour path through which a sheet (long sheet) P needed to correct its misalignment due to long sheet length, and is branched from an upstream side in the sheet conveyance direction FD of the short distance path 143 and joined on a downstream side in the sheet conveyance direction FD. The long distance path 144 has a substantially U character shape toward a lower direction, and includes straight portions 145, 147, 149, and bent portions 146, 148.

Note that the straight portion 145, the bent portion 146, the straight portion 147, the bent portion 148, and the straight portion 149 are sequentially positioned from the downstream side toward the upstream side in the sheet conveyance direction FD. That is, the straight portion (first straight portion) 145 is extended from one end of the bent portion 146, the straight portion (second straight portion) 147 is extended from the other end of the bent portion 146 toward one end of the bent portion 148, and the straight portion 149 is extended from the other end of the bent portion 148.

The alignment member 150 is formed by alignment members 150A to 150E disposed along the long distance path 144, and controlled by the control unit 132 (sheet conveyance program 135) in one or more embodiments. The control unit (sheet conveyance program 135) 132 determines two or more (a set of) alignment members to be operated depending on a sheet length L of the sheet P and causes the determined alignment members (or the determined set of alignment members) to align the sheet P as described below.

The alignment members 150A to 150E are disposed to be positioned on both sides of the sheet P and configured to be movable in the alignment direction (sheet width direction WD) as illustrated in FIG. 4. One of each of the pair of (or the set of) the alignment members 150A to 150E can have a different structure (e.g., fixed type) in one or more embodiments. Note that FIG. 4 illustrates an example in which the sheet P is aligned by the alignment members 150A to 150C. The reference numeral W denotes a sheet width.

The alignment member 150A is disposed on a sheet conveyance path on the downstream side of a joining point of the short distance path 143 and the long distance path 144, and is positioned near the roller 141 to be made contact with the leading edge of the sheet P. The alignment member 150B and the alignment member 150C are disposed on the straight portion 145. The alignment member 150D is disposed on the straight portion 147. The alignment member 150E is disposed on the straight portion 149.

That is, the alignment members 150A to 150E are provided on the straight portions 145, 147, 149 sandwiching the bent portions 146, 148 (positioned around the bent portions 146, 148). Accordingly, as compared with a case of being provided on the bent portions 146, 148, commonality of components of the alignment members 150A to 150E is easy. Note that the alignment members 150A to 150E may be referred to by the alignment member 150.

The alignment member 150 has a first guide part (guide) 152, a second guide part 154, and an alignment part 156 as illustrated in FIG. 5 in one or more embodiments.

The first guide part 152 and the second guide part 154 are faced with a predetermined gap (e.g., 3 mm), limit deformation of the sheet P by making the sheet P be positioned in the gap, and suppress generation of jam and a damage due to collision to another component positioned near the alignment member 150. For example, when the first guide part 152 is positioned on a lower direction, the second guide part 154 is positioned on an upper direction in a vertical direction GD, the first guide part 152 prevents hanging down of the sheet P due to its own weight, and the second guide part 154 prevents excessive deformation of the sheet P toward the upper direction.

The alignment part 156 has a concave shape projected toward outside, and includes a contact surface 157 and inclined surfaces 158A, 158B. The contact surface 157 is positioned on a bottom of the concave shape, and is formed to be made contact with a sheet side that is an end of the sheet in the sheet width direction WD. The inclined surface 158A is extended from one end of the contact surface 157 and is coupled to the first guide part 152. The inclined surface 158B is extended from the other end of the contact surface 157 and coupled to the second guide part 154. The inclined surfaces 158A, 158B are formed by a smooth curved surface to enable the sheet side to smoothly slide (move) toward the contact surface 157 when the alignment part 156 comes close to the sheet P.

The alignment member 150 has a plurality of functions such as an alignment function and a guide function, and its shape is complicated. Accordingly, in one or more embodiments, the alignment member 150 may be formed of a material superior in formability or processability (e.g., molded product made of aluminum or resin).

As illustrated in FIG. 6, the alignment member 150 is movable to the standby position, the guide position, and the alignment position.

The standby position is a position where a gap between the alignment members 150 faced is larger than the sheet width W, and where the alignment member 150 (first guide part 152 and the second guide part 154) does not in contact (interfered) with the sheet side. The guide position is a position where a gap between the alignment parts 156 of the respective alignment members 150 faced is larger than the sheet width W, and where the alignment part 156 is not in contact with the sheet side but the first guide part 152 and the second guide part 154 are in contact with the sheet P to exert the guiding function to limit deformation of the sheet P. The alignment position is a position where the gap between the alignment parts 156 of the respective alignment members 150 faced substantially matches with the sheet width W, so that the alignment part 156 is in contact with the sheet side to exert the alignment function to align the sheet P.

One or both of the first guide part 152 and the second guide part 154 can be also omitted in one or more embodiments. Reference numerals 172 and 173 denote a guide plate disposed on the sheet conveyance path 142 (short distance path 143 and long distance path 144), and a gap between the guide plates is, for example, 3 mm, and the guide plates are disposed to limit deformation at a center portion of the sheet P by being in contact with the center portion of the sheet P.

Next, the nip release mechanism 160 will be described.

Figure 7:
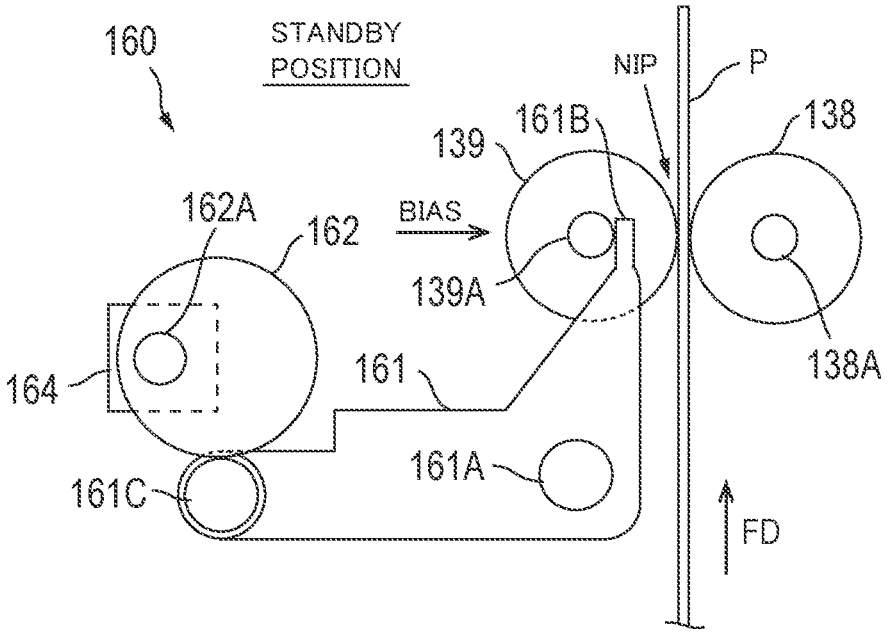
FIG. 7 is a schematic view for illustrating a nip release mechanism illustrated in FIG. 3.
Figure 8:
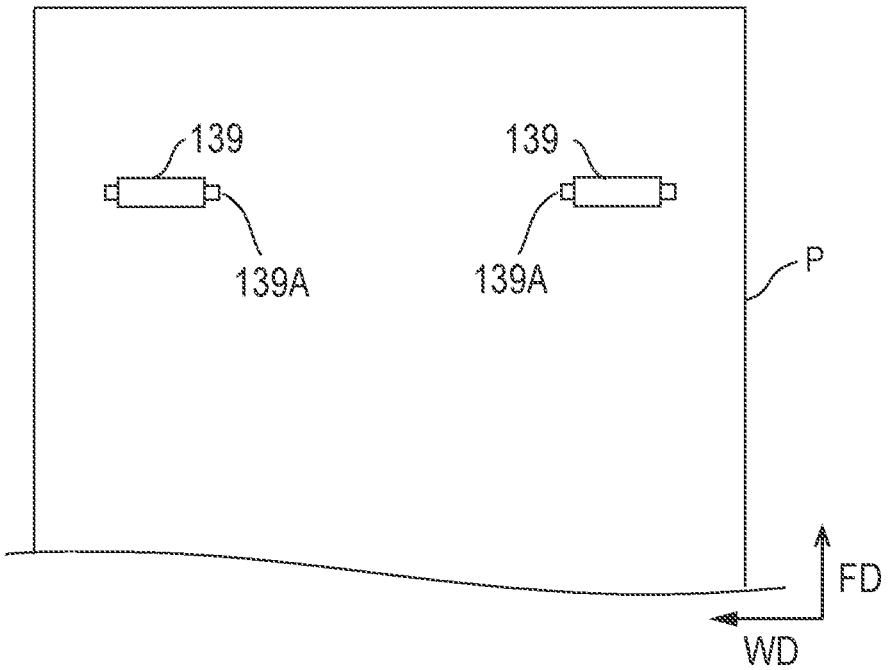
FIG. 8 is a schematic view for illustrating a placement direction of a conveyance roller of the nip release mechanism according to one or more embodiments.
Figure 9:
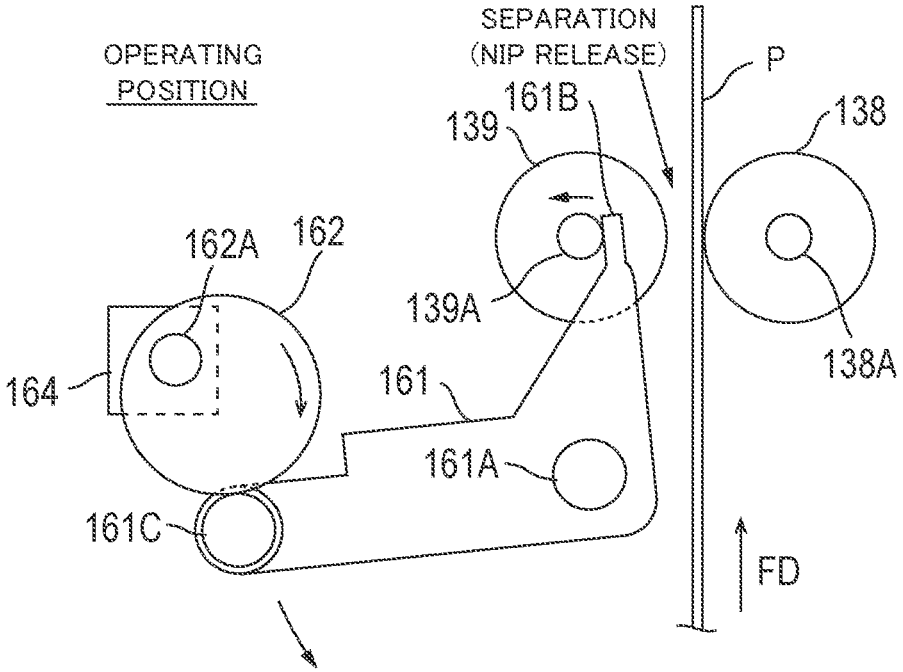
FIG. 9 is a schematic view for illustrating nip release of a sheet by the conveyance roller according to one or more embodiments.

FIG. 7 is a schematic view for illustrating the nip release mechanism illustrated in FIG. 3, FIG. 8 is a schematic view for illustrating a placement direction of a conveyance roller of the nip release mechanism, and FIG. 9 is a schematic view for illustrating nip release of the sheet by the conveyance roller.

The nip release mechanism 160 is formed of nip release mechanisms 160A to 160E disposed along the long distance path 144 (see FIG. 3), and controlled by the control unit 132 (sheet conveyance program 135) in one or more embodiments.

The nip release mechanism 160A and the nip release mechanism 160B are disposed on the straight portion 145 extended in the vertical direction GD, and the nip release mechanism 160A is positioned between the alignment member 150A and the alignment member 150B, and the nip release mechanism 160B is positioned between the alignment member 150B and the alignment member 150C. The nip release mechanism 160C is disposed on the straight portion 147 extended in a horizontal direction perpendicular to the vertical direction GD, and positioned between the alignment member 150C and the alignment member 150D. The nip release mechanism 160D and the nip release mechanism 160E are disposed on the straight portion 149 extended in the vertical direction GD, and the nip release mechanism 160D is positioned between the alignment member 150C and the alignment member 150D, and the nip release mechanism 160E is positioned between the alignment member 150D and the alignment member 150E. Note that the nip release mechanisms 160A to 160E are referred to by the nip release mechanism 160 as appropriate.

The nip release mechanism 160 is provided to release nipping of the sheet P by conveyance rollers 138, 139, and includes an L character shaped link part 161, an eccentric cam 162, and a driving motor 164 as illustrated in FIG. 7. Note that the conveyance rollers 138, 139 are a nipping member (nipper) for nipping the sheet P to convey the sheet P, and exert a force to nip the sheet P. Note that the conveyance roller 139 is biased toward the conveyance roller 138 by, for example, a spring.

Shafts 138A and shafts 139A of the conveyance rollers 138 and conveyance rollers 139 are disposed (positioned) along the sheet width direction WD as illustrated in FIG. 8, so that a rotation direction of the conveyance rollers 138, 139 matches with the sheet conveyance direction FD. Accordingly, the conveyance rollers 138, 139 are capable of conveying the sheet P with a nipped state. Although the two conveyance rollers 138 and the two conveyance rollers 139 are disposed in parallel along the sheet width direction WD, this is not specifically limited thereto, and arrangement thereof can be appropriately modified.

The L character shaped link part 161 includes a shaft 161A, a contact part 161B, and a lever 161C. The shaft 161A is positioned at a corner of the L character shaped link part 161, and the L character shaped link part 161 is freely rotatable around the shaft 161A. The contact part 161B is formed by an end of the L character shaped link part 161, and is positioned between the conveyance rollers 138, 139 and near the conveyance roller 139. The lever 161C is formed by another end of the L character shaped link part 161, and has a substantially cylindrical shape.

The eccentric cam 162 is configured to be freely rotatable around a shaft 162A, and configured to be contactable with the lever 161C of the L character shaped link part 161. The driving motor 164 is formed of, for example, a stepping motor, and configured to be able to rotatably drives the eccentric cam 162 to make the contact part 161B move between a standby position and an operating position.

The standby position is a position where the contact part 161B of the L character shaped link part 161 does not interfere with sheet nip by the conveyance rollers 138, 139, and forms, for example, a slight gap between the contact part 161B and the shaft 139A of the conveyance roller 139. The operating position is a position where the contact part 161B of the L character shaped link part 161 releases sheet nip by the conveyance rollers 138, 139 as illustrated in FIG. 9, and for example, the contact part 161B is made contact with the shaft 139A of the conveyance roller 139 and the contact force is made larger than a biased force of the conveyance roller 139 to drive (modify the position of) the shaft 139A of the conveyance roller 139.

That is, when the eccentric cam 162 is rotatably driven by the driving motor 164, the position of the lever 161C of the L character shaped link part 161 is changed. This makes the L character shaped link part 161 rotate around the shaft 161A to make the contact part 161B of the L character shaped link part 161 drive the shaft 139A of the conveyance roller 139 (exert a contact force larger than the biased force of the conveyance roller 139 in a reverse direction), thereby changing the position of the conveyance roller 139. This makes the conveyance roller 139 move in a direction away from the conveyance roller 138, releasing nipping of the sheet P.

Note that the mechanism of driving the lever 161C of the L character shaped link part 161 is not limited to the mode of using the eccentric cam and the driving motor, and applying, for example, a solenoid actuator is also possible.

Next, the fall prevention mechanism 165 will be described.

Figure 10:
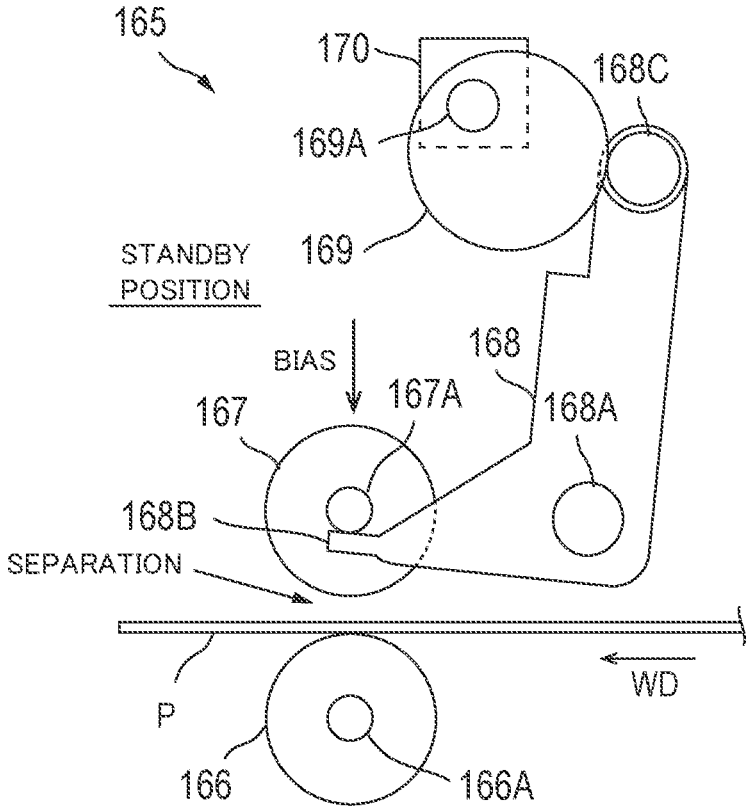
FIG. 10 is a schematic view for illustrating a fall prevention mechanism illustrated in FIG. 3.
Figure 11:
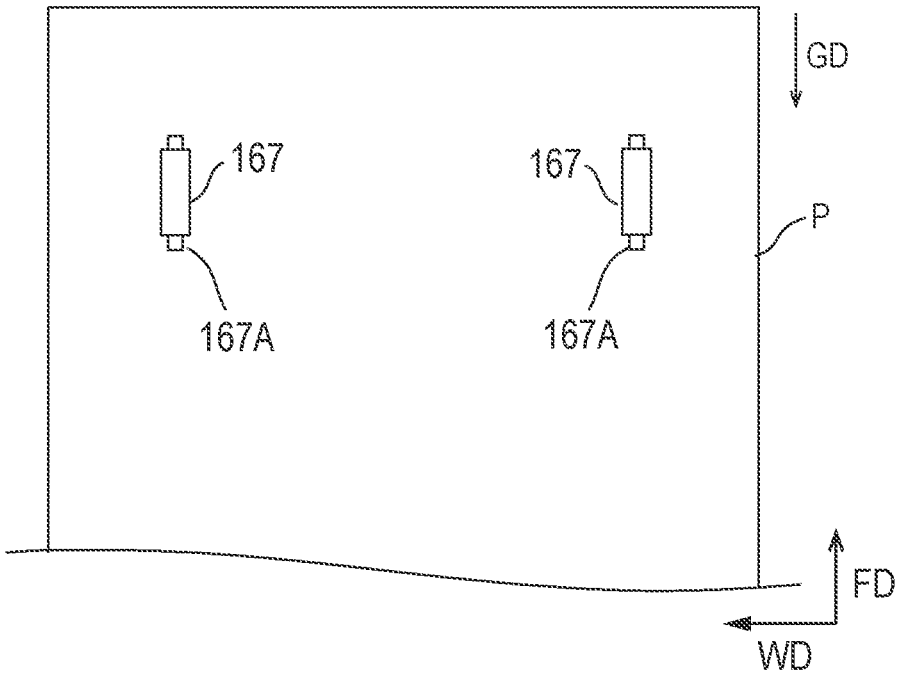
FIG. 11 is a schematic view for illustrating a placement direction of a holding roller of the fall prevention mechanism according to one or more embodiments.
Figure 12:
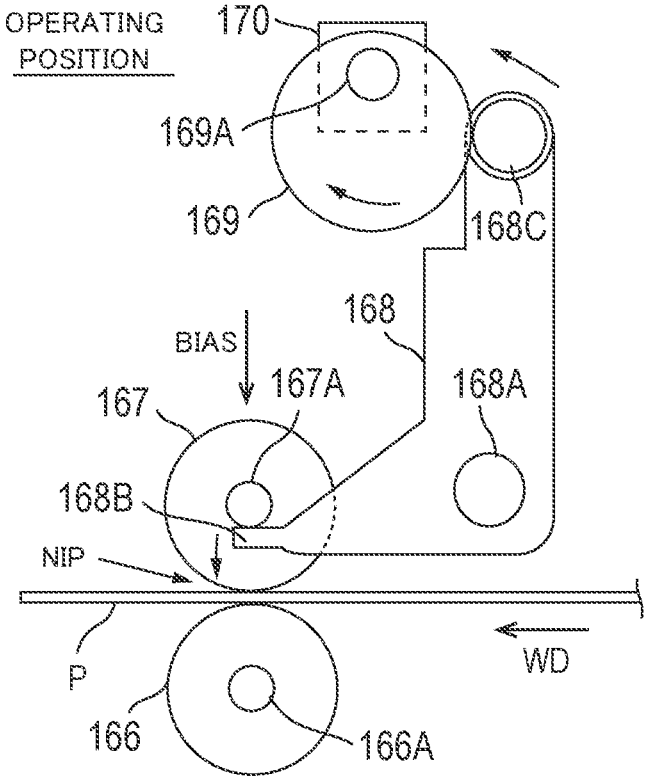
FIG. 12 is a schematic view for illustrating fall prevention of the sheet by the holding roller according to one or more embodiments.

FIG. 10 is a schematic view for illustrating the fall prevention mechanism illustrated in FIG. 3, FIG. 11 is a schematic view for illustrating a placement direction of a holding roller of the fall prevention mechanism, and FIG. 12 is a schematic view for illustrating fall prevention of the sheet by the holding roller.

In one or more embodiments, the fall prevention mechanism 165 is disposed on the straight portion 145 of the long distance path 144 extended in the vertical direction GD and disposed between the nip release mechanism 160A and the alignment member 150B (see FIG. 3). The fall prevention mechanism 165 may be disposed near a position at which a leading edge of the sheet P is positioned in a case where nipping is released, that is, at a high position of the straight portion 145 in order to hold the sheet P to prevent falling of the sheet P due to the own weight in a case where nipping of the sheet P is released by the nip release mechanism 160.

The fall prevention mechanism 165 includes holding rollers 166, 167, an L character shaped link part 168, an eccentric cam 169, a driving motor 170 as illustrated in FIG. 10.

The holding rollers 166, 167 are configured so as to be away at a standby position, and so as not to interfere with the sheet P passed through between the holding rollers 166, 167 to be conveyed. Shafts 166A and shafts 167A of the holding rollers 166 and the holding rollers 167 are disposed (positioned) along the sheet conveyance direction FD as illustrated in FIG. 11, so that a rotation direction of the holding rollers 166, 167 matches with the sheet width direction WD and is perpendicular to the sheet conveyance direction FD. The sheet width direction WD corresponds to the alignment direction, and the sheet conveyance direction FD corresponds to the vertical direction GD.

Accordingly, the holding rollers 166, 167 rotate to follow the movement of the sheet P due to the alignment operation, but do not rotate in a falling direction (vertical direction GD) of the sheet P. That is, the holding rollers 166, 167 make it possible to make the sheet P be aligned (moved in the alignment direction) in a state of nipping the sheet P (preventing falling). Note that, although the two holding rollers 166 and the two holding rollers 167 are disposed in parallel along the sheet width direction WD, this is not specifically limited thereto, and arrangement thereof can be appropriately modified. Also, the holding roller 167 is biased toward the holding roller 166 by, for example, a spring.

The L character shaped link part 168 includes a shaft 168A, a contact part 168B, and a lever 168C. The shaft 168A is positioned at a corner of the L character shaped link part 168, and the L character shaped link part 168 is freely rotatable around the shaft 168A. The contact part 168B is formed by an end of the L character shaped link part 168, positioned between the holding rollers 166, 167, and in contact with the shaft 167A of the holding roller 167. The lever 168C is formed by the other end of the L character shaped link part 168, and has a substantially cylindrical shape.

The eccentric cam 169 is configured to be freely rotatable around the shaft 169A, and configured to be contactable with the lever 168C of the L character shaped link part 168. The driving motor 170 is formed of, for example, a stepping motor, and configured to be able to rotatably drive the eccentric cam 169 to make the contact part 168B move between the standby position and the operating position.

The standby position is a position of the contact part 168B of the L character shaped link part 168 where sheet nip by the holding rollers 166, 167 is released (position where conveyance of the sheet by the conveyance rollers 138, 139 is not interfered). Note that, in the standby position, the contact part 168B is in contact with the shaft 167A of the holding roller 167.

An operating position is a position where sheet nip by the holding rollers 166, 167 is formed, and the holding rollers 166, 167 are rotatable in the sheet width direction WD (alignment direction) as illustrated in FIG. 12.

Accordingly, when the eccentric cam 169 is rotatably driven by the driving motor 170, the position of the lever 168C of the L character shaped link part 168 is changed. This makes the L character shaped link part 168 be rotated around the shaft 168A, and the contact part 168B of the L character shaped link part 168 move toward the holding roller 166, changing the position of the holding roller 167. That is, since being biased, the holding roller 167 moves with the movement of the contact part 168B made contact with its shaft 167A to come close to the holding roller 166, forming nipping of the sheet P as illustrated in FIG. 12.

Note that the mechanism of driving the lever 168C of the L character shaped link part 168 is not limited to the mode of using the eccentric cam and the driving motor, and applying, for example, a solenoid actuator is also possible.

Next, control of the alignment member by the control unit (sheet conveyance program) will be described.

Figure 13:
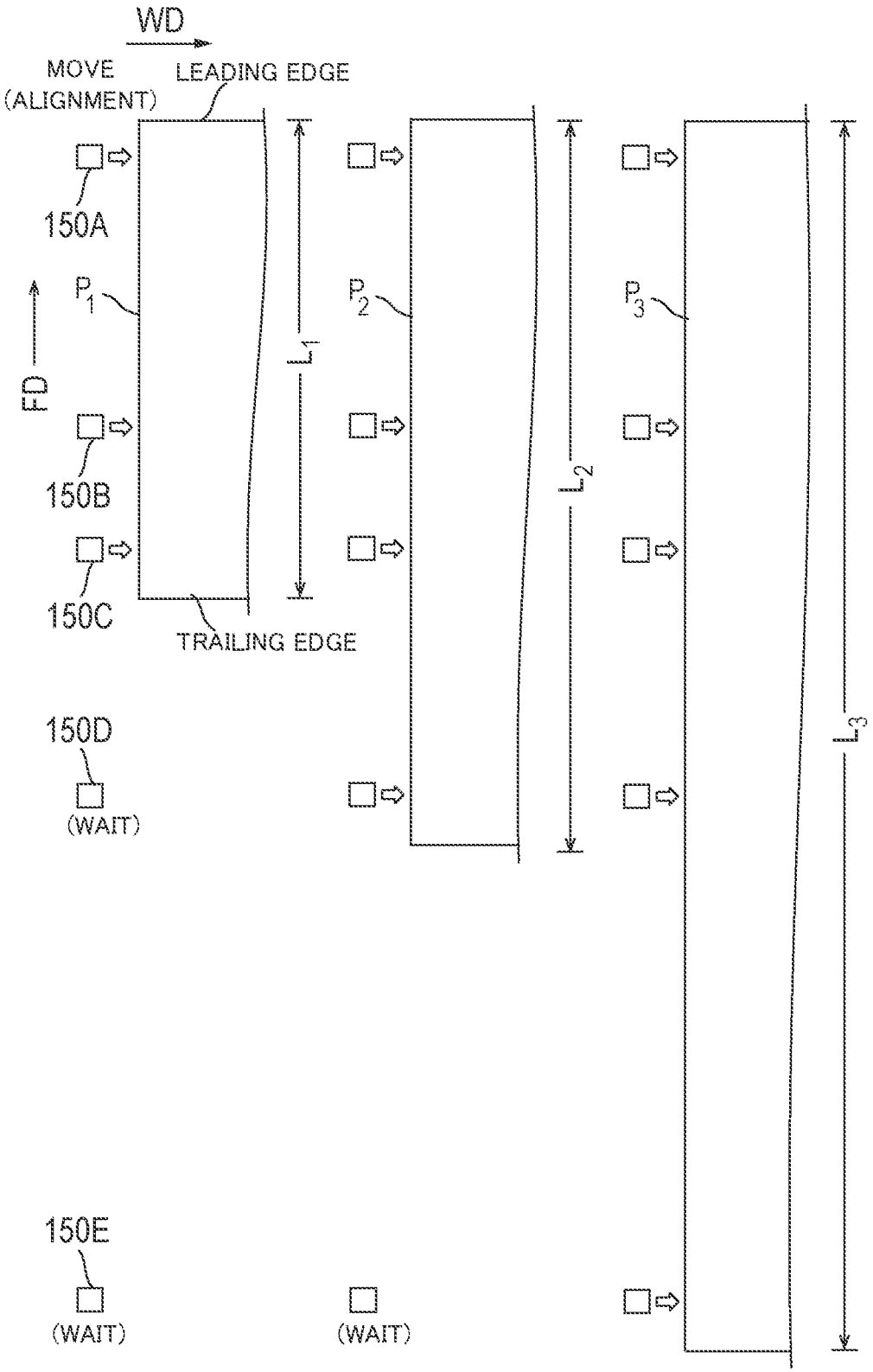
FIG. 13 is a schematic view for illustrating control of the alignment member (adding of an alignment member) according to one or more embodiments.

FIG. 13 is a schematic view for illustrating control of the alignment member (adding of an alignment member);

The control unit 132 of the sheet conveyance apparatus 130 determines (adds) two or more alignment members to be operated depending on the sheet length L of the sheet P and makes the alignment members determined align the sheet as illustrated in FIG. 13.

For example, for a sheet $P_1$ having a sheet length $L_1$, the alignment members 150A, 150B, 150C are operated, and the alignment members 150D, 150E are kept in a standby state. The alignment members 150A, 150B, and 150C are respectively disposed at a leading edge, a center portion, and a trailing edge of the sheet $P_1$, making it possible to successfully correct misalignment (bend or inclination) of the sheet $P_1$ (successfully obtain alignment effect). There is a risk in that the center portion does not follow the alignment operation to make correction of misalignment by the alignment member insufficient, so the alignment member 150B may be disposed.

In contrast, when a sheet $P_2$ having a sheet length $L_2$ larger than the sheet $P_1$ is aligned by the alignment members 150A, 150B, 150C, a trailing edge of the sheet $P_2$ is not aligned, which may disadvantageously make correction of misalignment insufficient. Therefore, the control unit 132 operates (adds) the alignment member 150D in addition to the alignment members 150A, 150B, 150C. The alignment members 150D is disposed at the trailing edge (near trailing edge) of the sheet $P_2$, so that correction of misalignment of the sheet $P_1$ becomes good also at the trailing edge of the sheet $P_2$.

Also, when a sheet $P_3$ having a sheet length $L_3$ larger than the sheet $P_2$ is conveyed, the alignment member 150E is operated in addition to the alignment members 150A, 150B, 150C, 150D. The alignment members 150E are disposed at a trailing edge of the sheet $P_3$, so that correction of misalignment becomes good also at the trailing edge of the sheet $P_3$.

That is, even when the sheet P is a long sheet in the sheet conveyance direction FD, the number of alignment members used is increased (changed) depending on its sheet length, so that correction of misalignment (bend or inclination) by the alignment members becomes good also at the center portion of the sheet and the size of alignment member is not increased, suppressing upsizing of the sheet conveyance apparatus.

Next, a determination method of the alignment members to be added will be described in detail.

FIG. 14A, FIG. 14B, and FIG. 14C is a table for illustrating a relation among sheet length, cover rate, and misalignment.

The cover rate is a value in percentage obtaining by dividing an alignment member operation range by the sheet length L. The alignment member operation range is a length along a conveyance path between a position of the alignment member (first alignment member) positioned on the most downstream side and a position of the alignment member (second alignment member) positioned on the most upstream side in the sheet conveyance direction FD among the alignment members operated. In one or more embodiments, lengths along the conveyance path from a sheet leading edge position to the alignment member 150A, the alignment member 150B, the alignment member 150C, the alignment member 150D, and the alignment member 150E are respectively 39 mm, 420 mm, 567 mm, 757 mm, and 1013 mm. Accordingly, the cover rate [%] is defined by a formula ((length along the conveyance path from the sheet leading edge position to the alignment member positioned on the most upstream side [mm]−39)/the sheet length L [mm])×100). Note that, the sheet leading edge position denotes a position where the leading edge of the sheet P is made contact with the roller 141.

The misalignment of the sheet increases (deteriorates) as the sheet length becomes longer as illustrated in FIG. 14A to FIG. 14C. An allowable value of the misalignment of the sheet is, for example, 1.4 mm, and a cover rate causing misalignment of 1.4 mm is 74% (see FIG. 14A and FIG. 14B). That is, to keep the misalignment of the sheet to be not more than 1.4 mm, a length along the conveyance path between the first alignment member positioned on the most downstream side and the second alignment member positioned on the most upstream side in the sheet conveyance direction is not less than 74% of the sheet length of the sheet applied in one or more embodiments.

For example, when the sheet length is from 540 mm to 710 mm, operating the alignment member 150A, the alignment member 150B, and the alignment member 150C makes it possible to keep the misalignment of the sheet P to be not more than the allowable value (see FIG. 14A). Also, when the sheet length is from 720 mm to 970 mm, adding the alignment member 150D for operation makes it possible to keep the misalignment of the sheet P to be not more than the allowable value (see FIG. 14B). Also, when the sheet length is from 980 mm to 1300 mm, adding the alignment member 150E for operation makes it possible to keep the misalignment of the sheet P to be not more than the allowable value (see FIG. 14B and FIG. 14C).

The allowable value of the misalignment of the sheet P is not specifically limited to 1.4 mm, and can be modified as appropriate depending on necessity (e.g., in consideration for required accuracy in the post-processing). The number and disposed positions of the alignment members 150, the nip release mechanisms 160, and the fall prevention mechanisms 165 are not limited to the above-mentioned mode, and can be adequately set in consideration of size and structure of the long distance path 144, the minimum length and the maximum length of the sheets P applied, and the like.

Next, a sheet conveyance method according to one or more embodiments of the present invention will be described.

Figure 15A:
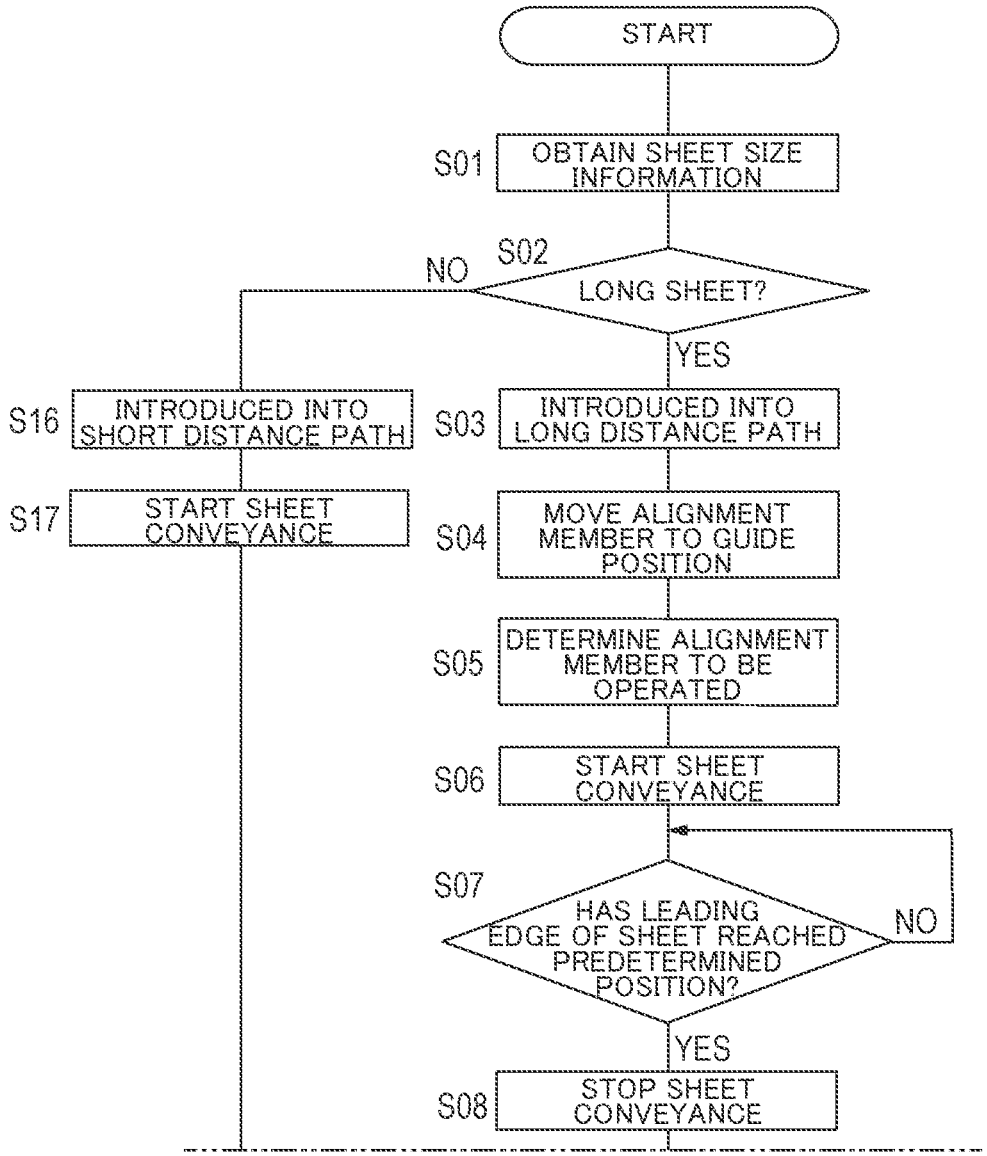
FIG. 15A is a flow chart for illustrating a sheet conveyance method according to one or more embodiments of the present invention.
Figure 15B:
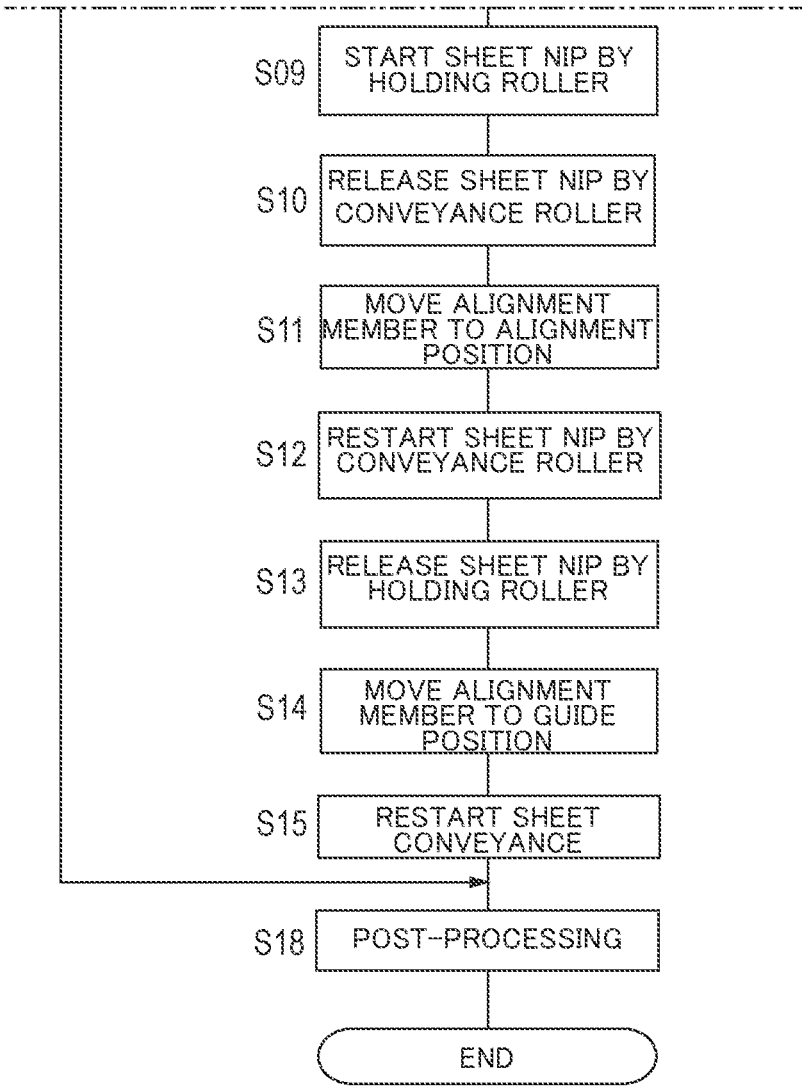
FIG. 15B is a flow chart subsequent to FIG. 15A.

FIG. 15A and FIG. 15B are a flowchart for illustrating the sheet conveyance method according to one or more embodiments of the present invention. Note that an algorism illustrated by the flowchart illustrated in FIG. 15A and FIG. 15B is stored as the sheet conveyance program 135, and executed by the control unit 132.

First, as illustrated in FIG. 15A, sheet size information transmitted from the image forming apparatus 110 is obtained via the internal communication unit 176 (step S01), and whether the sheet P conveyed from the image forming apparatus 110 is a long sheet is determined (step S02).

When it is determined that the sheet P is not a long sheet (non-long sheet having a short sheet length and scarcely needed to correct misalignment (bend or inclination)) (NO in step S02), the sheet P is introduced into the short distance path (straight path) 143 (step S16). Then, sheet conveyance is started (step S17), and the process proceeds to step S18.

In contrast, when it is determined that the sheet P is a long sheet (sheet having a long sheet length and needed to correct misalignment) (YES in step S02), the sheet P is introduced into the long distance path (detour path) 144 (step S03). Then, the alignment members 150A to 150E disposed along the long distance path 144 are driven to move to the guide position from the standby position (see FIG. 6) (step S04).

Next, when two or more alignment members to be operated are determined from among the alignment members 150A to 150E to make the misalignment of the sheet P become not more than the allowable value with reference to, for example, FIG. 14A to FIG. 14C on the basis of the sheet length L of the sheet P (step S05), sheet conveyance is started (step S06). In this context, the alignment members 150A to 150E are at the guide position, so that the first guide part 152 and the second guide part 154 of each of the alignment members 150A to 150E is in contact with the sheet P being conveyed, limiting deformation of the sheet P (e.g., preventing hanging down of the sheet P due to own weight).

Then, whether the leading edge of the sheet P reaches a predetermined position is determined (step S07). Reaching the predetermined position is detected when the sheet P is made contact with the roller 141 positioned on the sheet conveyance path on the downstream side of a joining point of the short distance path 143 and the long distance path 144 (see FIG. 3). The detection of reaching the predetermined position is not specifically limited to the configuration.

Then, when it is determined that the leading edge of the sheet P reaches the predetermined position (YES in step S07), sheet conveyance is stopped (step S08).

Then, the fall prevention mechanism 165 and the nip release mechanism 160 are sequentially operated (step S09 and step S10). That is, when the sheet P is held by the holding rollers 166, 167 of the fall prevention mechanism 165 (sheet nip is started), the conveyance rollers 138, 139 are controlled by the nip release mechanism 160, and nipping of the sheet P by the conveyance rollers 138, 139 is released. This prevents the sheet P from falling, and in contrast, makes the sheet P be held in a freely movable manner (movably held) in the alignment direction (sheet width direction WD) perpendicular to the sheet conveyance direction FD.

Then, only the alignment member determined to be operated is driven to move to the alignment position (see FIG. 6) (step S11). This makes the alignment part 156 of the alignment member be made contact with the sheet side to exert the alignment function for aligning the sheet P. For example, in the example of FIG. 13, the alignment members 150A to 150C are driven for the sheet $P_1$ having the sheet length $L_1$, the alignment members 150A to 150D are driven for the sheet $P_2$ having the sheet length $L_2$, and the alignment members 150A to 150E are driven for the sheet $P_3$ having the sheet length $L_3$. This enables to successfully correct misalignment (bend or inclination) of the sheet (successfully obtain alignment effect).

When alignment of the sheet P is completed, operations of the nip release mechanism 160 and the fall prevention mechanism 165 are sequentially stopped (step S12 and step S13). That is, when control of the conveyance rollers 138, 139 are stopped and nipping of the sheet P by the conveyance rollers 138, 139 is restarted by the nip release mechanism 160, holding of the sheet P (sheet nip) by the holding rollers 166, 167 of the fall prevention mechanism 165 is released. This makes the sheet P be held in a freely movable manner in the sheet conveyance direction FD.

Then, when the alignment member positioned at the alignment position (that have executed the alignment operation) is driven to move to the guide position (step S14), sheet conveyance is restarted (step S15), and the process proceeds to step S18.

In step S18, the sheet P is passed through the sheet conveyance apparatus 130 and supplied to the post-processing apparatus 180 to be subjected to the post-processing (cutting by the rotary cutter 187), and the process is finished. In this context, the sheet P is corrected in misalignment (bend or inclination), suppressing to yield a defective good (inclined or bent deliverable) by cutting by the rotary cutter 187.

Next, a modification of one or more embodiments of the present invention will be described.

Figure 16:
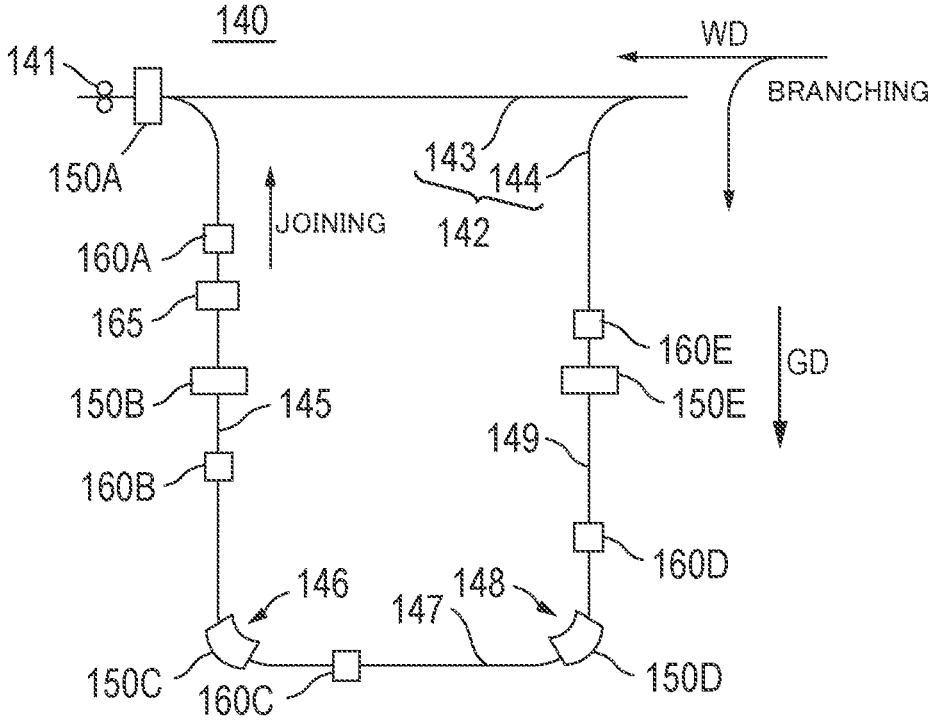
FIG. 16 is a schematic view for illustrating a modification of one or more embodiments of the present invention.

FIG. 16 is a schematic view for illustrating a modification of one or more embodiments of the present invention.

The alignment member 150A to 150E is not limited to the mode where they are disposed on the straight portions 145, 147, 149 of the long distance path 144. For example, there is a case in that frictional force of the sheet P becomes extremely large at the bent portions 146, 148 due to strain of the sheet P to fail to achieve a predetermined alignment level even when the alignment operation is performed at the straight portions 145, 147, 149. Therefore, the alignment members 150C, 150D may be respectively disposed to the bent portions 146, 148 as illustrated in FIG. 16.

It is desirable that the alignment members 150C, 150D respectively disposed to the bent portions 146, 148 have a rounded shape (R shape) in view of scratch, resulting in a complicated shape. Therefore, the bent portions 146, 148 may be formed of a molded product made of aluminum or resin having good formability or process ability.

As described above, according to the sheet conveyance method, the sheet conveyance apparatus, and the image forming system according to one or more embodiments, two or more alignment members to be operated are determined from among a plurality of alignment members on the basis of a sheet length of a paper sheet, and the paper sheet is aligned by the determined alignment members. That is, even when the paper sheet is a sheet long in the sheet conveyance direction (long sheet), the number of alignment members used is increased (changed), so that correction of misalignment (bend or inclination) by the alignment members becomes good also at, for example, a center portion of the paper sheet and the size of alignment member is not increased, suppressing upsizing of the sheet conveyance apparatus. This makes it possible to provide a sheet conveyance method, a sheet conveyance apparatus, and an image forming system capable of successfully correcting misalignment (bend or inclination) of paper sheets having various sizes while suppressing upsizing of the sheet conveyance apparatus.

The present invention is not limited to the above-described embodiments, and various modifications are possible within the scope of the claims. For example, the sheet conveyance apparatus is not limited to be disposed between the image forming apparatus and the post-processing apparatus, and for example, can be disposed on the upstream side of the image forming apparatus in the sheet conveyance direction to align the sheet supplied to the image forming apparatus.

The sheet conveyance program embodying the sheet conveyance method according to one or more embodiments of the invention can be also provided by a dedicated hardware circuit. The sheet conveyance program can be also provided by a computer readable recording medium such as a USB (Universal Serial Bus) memory, a DVD (Digital Versatile Disc), or a ROM (Read Only Memory), or provided by online via a network such as the Internet. In this case, the sheet conveyance program is typically stored in a storage device such as a magnetic disc device forming the storage unit. Also, the sheet conveyance program can be provided as independent application software, or can be provided by incorporating it in another software as one function.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A sheet conveyance method using a sheet conveyance apparatus that comprises a conveyance path and a plurality of alignment members disposed along the conveyance path, the method comprising:

storing, in a storage, sheet size information including a length of the paper sheet in a conveyance direction;

based on the sheet size information, determining, from among the alignment members, a set of alignment members that respectively correspond to at least a leading edge and a trailing edge of the paper sheet and that are operated for aligning the paper sheet; and moving the determined set of alignment members for the aligning.

2. The sheet conveyance method according to claim 1, wherein the conveyance path comprises a bent portion, and at least one of the alignment members is disposed on the bent portion.

3. The sheet conveyance method according to claim 1, wherein the conveyance path comprises a bent portion, a first straight portion extended from one end of the bent portion, and a second straight portion extended from another end of the bent portion, and at least one of the alignment members is disposed on the first straight portion and another of the alignment members is disposed on the second straight portion.

4. The sheet conveyance method according to claim 1, wherein the sheet conveyance apparatus comprises a nipper that nips the paper sheet conveyed, and releases nipping of the paper sheet during the aligning.

5. The sheet conveyance method according to claim 4, wherein the sheet conveyance apparatus comprises a pair of holding rollers that hold the paper sheet while the nipping of the paper sheet is released, and the paper sheet is movably held by the holding rollers in an alignment direction perpendicular to the conveyance direction.

6. The sheet conveyance method according to claim 1, wherein each of the alignment members comprises a guide that guides the paper sheet, and the method further comprises:

preventing, using the guide, the paper sheet from hanging down while the paper sheet is conveyed.

7. The sheet conveyance method according to claim 1, wherein the determined set of alignment members comprises:

a first alignment member positioned on a most downstream side; and a second alignment member positioned on a most upstream side in the conveyance direction, and a length along the conveyance path between the first alignment member and the second alignment member is not less than 74% of the length of the paper sheet.

8. The sheet conveyance method according to claim 1, wherein the alignment members is formed of a molded product made of aluminum or resin.

9. A sheet conveyance apparatus comprising:

a conveyance path along which a paper sheet is conveyed;

a plurality of alignment members disposed along the conveyance path; and a controller that controls the alignment members, wherein the controller:

stores, in a storage, sheet size information including a length of the paper sheet in a conveyance direction, based on the sheet size information, determines, from among the alignment members, a set of alignment members that respectively correspond to at least a leading edge and a trailing edge of the paper sheet and that are operated for aligning the paper sheet, and moving the determined set of alignment members for the aligning.

10. An image forming system comprising:

the sheet conveyance apparatus according to claim 9;

an image forming apparatus that is positioned on an upstream side of the sheet conveyance apparatus in the conveyance direction, and that forms an image on the paper sheet to be supplied to the sheet conveyance apparatus; and a post-processing apparatus that is positioned on a downstream side of the sheet conveyance apparatus in the conveyance direction, and that subjects the aligned paper sheet to post processing.

* * * * *